US006105977A

United States Patent [19]

Bengtsson et al.

[11] Patent Number: 6,105,977

[45] Date of Patent: Aug. 22, 2000

[54] ROLLER CONTRIVANCE INTENDED FOR AT LEAST ONE FOOT

[75] Inventors: Kent Bengtsson, Örebro; Jerker Swande, Stockholm, both of Sweden

[73] Assignee: Orebroskenan Aktiebolag, Orebro, Sweden

[21] Appl. No.: 08/913,284

[22] PCT Filed: Mar. 15, 1996

[86] PCT No.: PCT/SE96/00336

§ 371 Date: Oct. 22, 1997

§ 102(e) Date: Oct. 22, 1997

[87] PCT Pub. No.: WO96/29127

PCT Pub. Date: Sep. 26, 1996

[30] Foreign Application Priority Data

Mar. 16, 1995 [SE] Sweden ..... 9500922
Mar. 16, 1995 [SE] Sweden ..... 9500923

[51] Int. Cl.[7] ..... A63L 1/00

[52] U.S. Cl. ..... 280/11.22; 280/11.28

[58] Field of Search ..... 280/11.22, 11.23, 280/11.27, 11.28, 87.042, 11.19

[56] References Cited

U.S. PATENT DOCUMENTS

| | | | |
|---|---|---|---|
| 3,484,116 | 12/1969 | Allen . | |
| 4,838,564 | 6/1989 | Jarvis . | |
| 5,085,445 | 2/1992 | Boyden | 280/11.28 |
| 5,397,138 | 3/1995 | Mangelsdorf | 280/11.28 |

FOREIGN PATENT DOCUMENTS

| | | |
|---|---|---|
| 2814888 | 10/1979 | Germany . |
| 94 029998 | 9/1994 | Sweden . |

*Primary Examiner*—Richard M. Camby
*Attorney, Agent, or Firm*—Sughrue, Mion, Zinn, Macpeak & Seas, PLLC

[57] ABSTRACT

A roller contrivance for use with at least one foot, such as a roller skate (1), skateboard, roller ski or the like, comprising a base frame (2) and at least one row of mutually sequential rollers (3) mounted to the base. At least one of these rollers (3) is journalled in a holder (6) which is pivotally mounted to the base (2). The holder is able to pivot about an axis which forms a right angle with the rotational axis of the roller (3) and is located at a given distance from a roller center line (10) which passes through the roller journal point (8) and its point of contact (21) with the underlying surface.

12 Claims, 7 Drawing Sheets

ROLLER CONTRIVANCE INTENDED FOR AT LEAST ONE FOOT

The present invention relates to a roller contrivance intended for at least one foot, such as a roller skate, skateboard, roller ski or the like, comprising a base frame and at least one row of mutually sequential rollers mounted on said frame.

A conventional roller skate includes two pairs of rollers fixed to the base frame. In order to change direction when skating on roller skates of this kind, the skater must lift at least one roller pair of each skate so as to be able to turn his/her feet. In recent years, there has been developed another type of roller skate which includes a series of rollers attached mutually sequentially beneath the skate shoe, i.e. so-called roller blades. The rollers of such skates are also fixed in the longitudinal direction. This type of roller skates, which typically include four or five rollers, afford a slightly more rigid skating action, wherein the foot must be lifted slightly higher each time the skating direction is corrected. This is compensated for by the fact that the narrow, blade-like array of rollers are more similar to the blade or runner of a conventional ice skate, wherein the method of skating is very similar to conventional ice-skating, much more so than with the older roller skates in which the rollers are arranged in pairs, despite the difficulty in steering the roller blades in motion.

One important difference between roller-skating and conventional ice-skating is that the friction generated between the rollers and the solid undersurface is considerably higher than the friction generated between the blade of an ice skate and the ice. It is easy to skid on ice skates, i.e. to slide laterally to the direction of travel, which is not possible to achieve on roller skates because of the friction generated between rollers and underlying surface. Consequently, it is not possible to achieve with known roller skates the elegance and self-assurance that can be achieved with ice skates. Added to this is the difficulty of stopping abruptly in a controllable fashion, since it is not possible to skid to an abrupt stop on roller skates. Present-day roller blades normally have a rubber brake block on the heel of the shoe, which can be brought into contact with the underlying surface by inclining the shoe rearwardly, therewith to obtain a braking effect.

Another essential difference between conventional ice skates and roller skates is the impossibility of starting from a stationary position on a flat surface and skating backwards when wearing known roller skates. Skating backwards is an important part of the technique employed by ice-hockey players and bandy players during the game. Backward skating is also an important feature in figure skating. The only way of moving "backwards" on traditional roller skates is to jump up when moving forwards and twist the body and the skates through 180°. This is very difficult to achieve, besides being risky, and does not enable the skater to increase rearward speed on a flat skating surface.

What has been discussed in the aforegoing with regard to known roller skates also applies to a large extent to conventional skateboards, which are normally provided with two pairs of wheels fixed in the longitudinal direction of the board.

An object of the present invention is to provide a roller contrivance which is intended for use with at least one foot, for instance a roller skate, skateboard, roller ski or like contrivance that has improved maneuverability and which enables directional changes to be made when moving forwards or backwards.

Another object is to provide a roller skate on which a skater is able to skate more like the manner of a conventional ice skate than was previously possible with roller skates.

Another object is to provide a roller skate with which the skater is able to skate backwards in essentially the same way as that permitted by a conventional ice skate.

Yet another object of the invention is to provide a roller skate that has a brake function which is coupled to the rollers such as to come into force when the skate is positioned cross-wise, as in the case of a stop skid when ice-skating.

The invention is based on the concept that the aforesaid objects can be achieved with a roller contrivance that has mutually sequential rollers, by mounting at least one of these rollers in a manner which will enable said roller to be pivoted or twisted laterally, and such that said lateral pivoting of the roller will be dependent, among other things, on the angle to which the roller is inclined or tilted relative to the base frame to which the rollers are attached.

Accordingly, the particular characteristic features of a roller contrivance of the kind defined in the first paragraph are that at least one of the rollers is journalled in a holder which is pivotally mounted on the frame such as to enable said roller to pivot about an axis which defines a right angle with the rotational axis of the roller and which is located at a given distance from a roller centre line that passes through the roller journal point and its point of contact with the skating surface.

In the case of a roller skate in which the rollers are attached in the aforesaid manner, outward swinging of the pivotal roller or rollers will be influenced by the tilt angle of the skate, therewith substantially increasing the manoeuvreability. When the rollers are able to swing freely through 360°, the skater is also able to skate backwards with the same type of skating movements as those associated with ice-skating.

Thus, the manoeuvreability with this type of roller skates is very good and is similar to that obtainable with conventional ice skates, since the pivot angle of the rollers is determined by the angle of inclination of the skater, wherein the turning radius decreases with increasing angles of inclination, as with ice skates.

A braking effect can be incorporated by journalling at least one of the rollers for free rotation in only one direction, corresponding to a forward skating direction, but which provides a braking effect when rotating in the opposite direction. Alternatively, at least one of the pivotal rollers may be adapted to come into contact with an external brake means after having pivoted through a given angle, said brake means exerting a braking effect on the roller.

Other features of the invention will be apparent from the following claims.

The invention will now be described in more detail with reference to exemplifying embodiments thereof and also with reference to the accompanying drawings, in which FIG. 1 illustrates a known roller-blade skate;

Figure 14:
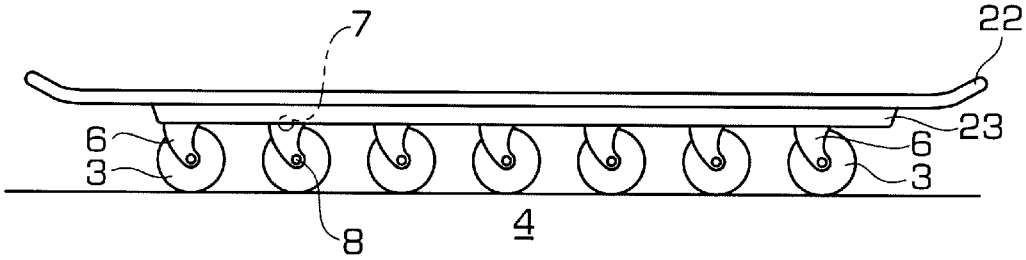
FIG. 14 illustrates a modified version of the inventive skateboard.
Figure 14A:
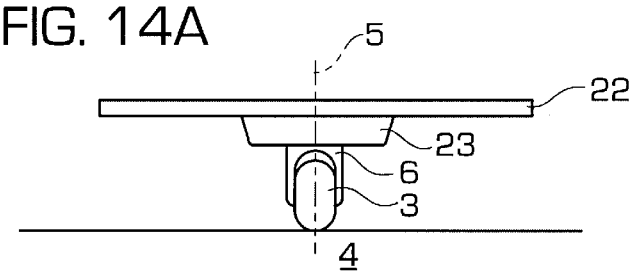
FIG. 14A is a rear view of the skateboard shown in FIG. 14.
Figure 14B:
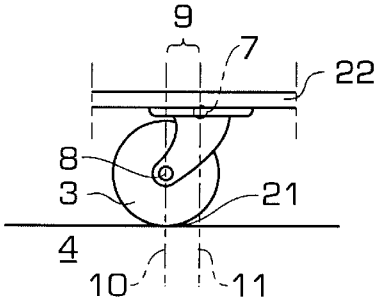
Figure 14C:
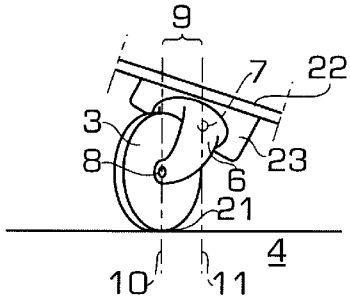
Figure 14D:
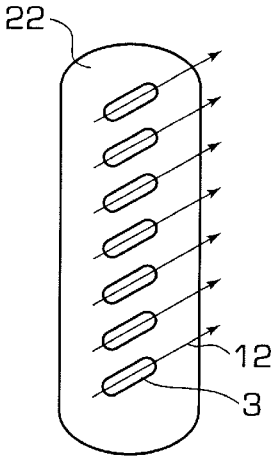
Figure 15:
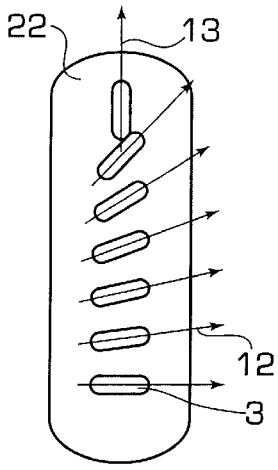
Figure 16A:
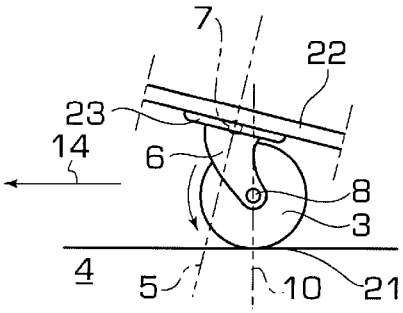
Figure 16B:
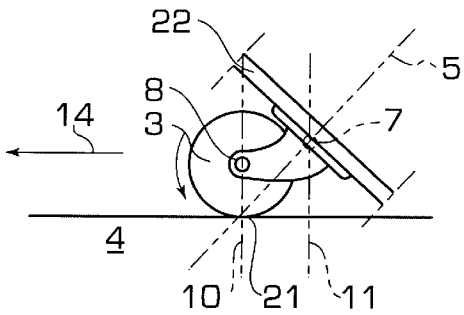

FIGS. 14B and 14C respectively illustrate the roller suspension in side view with a horizontal board and from the rear of a tilted board;

FIG. 14D illustrates the roller positions in the situation illustrated in FIG. 14C;

FIG. 15 illustrates the roller positions on a tilted board that has a fixed front roller; and FIGS. 16A and 16B illustrate a roller when skating sideways with the board slightly tilted and with the board tilted to such an extent as to reverse the rotational direction of the roller.

Figure 1:
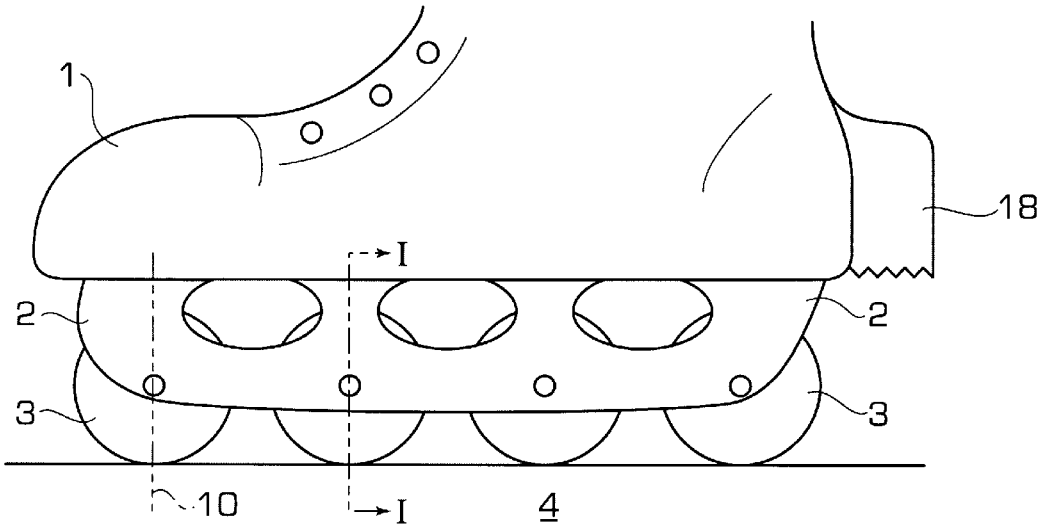
FIGS. 1A and 1B are sectional views taken on the line I—I in FIG. 1 and show respectively the skate in a vertical and tilted position.

FIG. 1 illustrates a known type of roller-blade skate which includes a base frame 2 in which a plurality of rollers 3 are mounted for free rotation in both directions. Mounted on the heel of the skate is a rubber buffer 18 which can be brought into engagement with the underlying skating surface 4 and therewith provide a certain braking effect, by tipping the skate backwards. The lateral mobility of this type of roller skate is limited because the rollers are only able to rotate in a common direction and in the same track on the underlying surface 4.

Figure 1A:
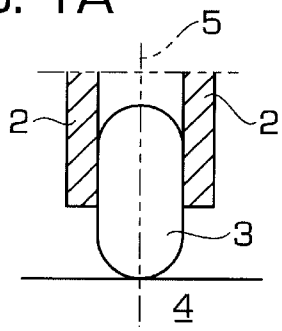
Figure 1B:
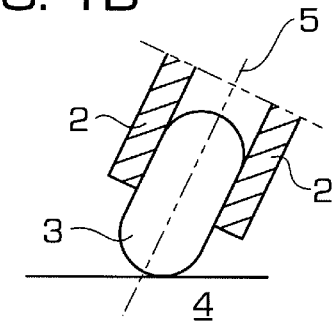

The rollers 3 cannot be pivoted in relation to the base frame, meaning that the skate balance line 5 will extend centrally through the roller 3 irrespective of the angle at which the skate is inclined to the underlying surface; c.f. FIGS. 1A and 1B.

The rollers non-pivotally mounted on the base frame solely permit the skater to skate in one direction and necessitates the skater to lift a skate from the ground and lower the skate in a different, desired direction in order to change his/her direction of movement when negotiating a curve. The skating direction is thus not influenced by the angle of the rollers 3 to the underlying surface 4, since not even pronounced tilting of the skate will change the setting of the rollers in relation to the skate; see FIG. 1B. Also in this case the balance line of the skate passes through the roller 3. Since all rollers are fixedly set in line with one another, all rollers will run in one and the same track. This makes it impossible to skate backwards with the technique used with ice skates.

Figure 2:
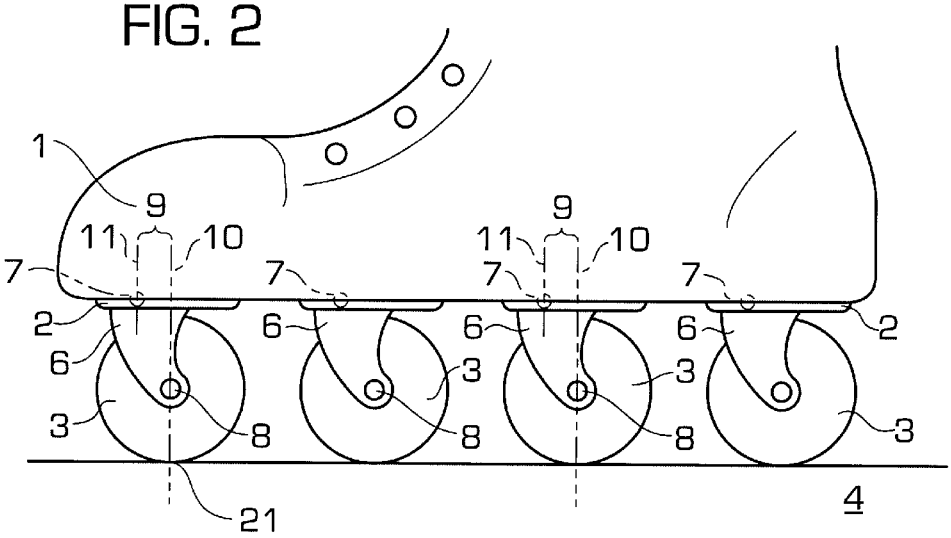
FIG. 2 illustrates a modified version of the roller-blade skate in accordance with the present invention.

FIG. 2 illustrates a first embodiment of an inventive roller-blade skate. In this embodiment, all rollers 3 are journalled in holders 6 having base plates 2 which can each be pivoted or twisted through 360° around a skate attachment point 7. In this case, the base is comprised of a number of individual base plates 2 which may be attached directly to the sole of the skate shoe 1 or to a rail or plate mounted on said sole. The holders 6 are slightly curved, such as to displace the journal point 8 of each roller shaft through a distance 9 from the pivot point 7. This enables the journal point 8 of each roller to move around a circle of radius 9 that circumscribes the pivot point 7 when the skate is upright.

Figure 2A:
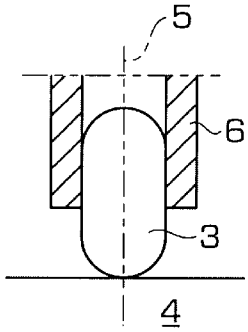
FIGS. 2A–2C are rear views of the bottom part of the skate and respectively show the skate in a vertical position and in positions of different degrees of inclination.

A centre line 10 for respective rollers between their journal points 8 and their point of contact 21 with the underlying surface 4 will be parallel with the skate balance line 5 and also with a vertical line 11 passing through the pivot point 7, see FIGS. 2 and 2A. When the skate is tilted so that the rollers are twisted or pivoted, the distance 9 between the lines 10 and 11 will increase with increasing tilting angles; see FIGS. 2B and 2C.

Figure 3A:
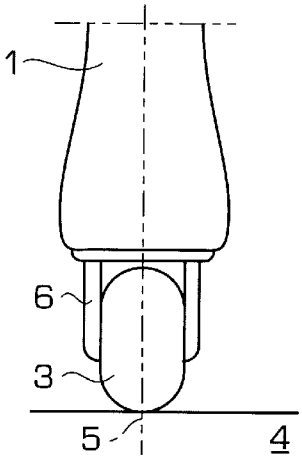
FIGS. 3A–3C are rear views of the skate and show respectively the skate in a vertical position, in a pivoted position and in an inclined position.
Figure 3B:
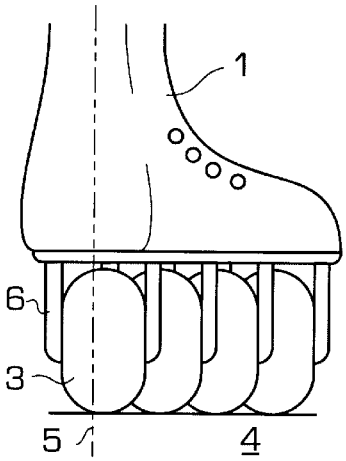
Figure 4A:
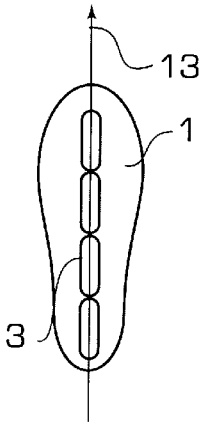
FIGS. 4A–4C illustrate the positions of the rollers in each of the three situations illustrated in FIG. 3.
Figure 4B:
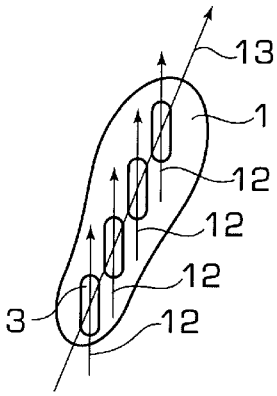

When skating upright in a forward direction, the rollers are in the positions shown in FIGS. 3A and 4A. The skate or shoe can be simply twisted laterally in relation to the rollers without changing the position of the rollers or the skating direction; see FIGS. 3B and 4B. In this regard, the centre line 10 of the rollers 3 is swung out laterally in relation to the shoe while remaining parallel with the shoe balance line 5. The direction in which the skater moves is determined by the roller setting.

Figure 3C:
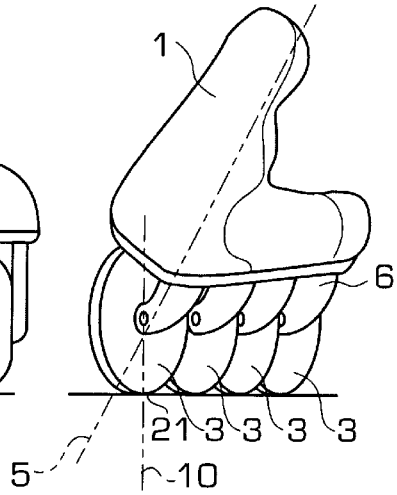
Figure 4C:
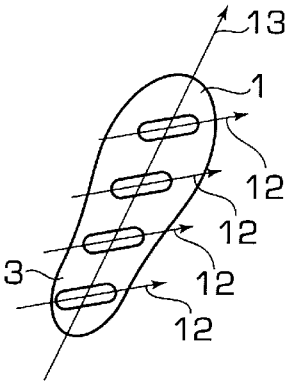

When the skate is tilted so as to move in a curved path, the roller centre line 10 will be swung laterally outwards and in a direction opposite to the skate tilting direction. This is due to a change in the angle between the skate balance line 5 and the roller centre line 10, said change generating a twisting force on the rollers, as seen from FIGS. 3C and 4C. When the turn is completed and the skate is returned to a vertical position, the rollers will be guided in a direction towards the point towards which the direction 13 of the skate points.

Because the roller centre line 10 lies behind the vertical line 11 through the pivot point 7 when skating in a forward direction, the rollers 3 will be set in line with the direction of movement. As before mentioned, when the skate is tilted in negotiating a curve, the ratio between the skate balance line 5 and the roller centre line 10 is influenced, wherein the influence exerted by tilting of the skate becomes less with higher speeds. The turning radius, or swinging radius, is also affected by individual differences in the distance 9 between the pivot point 7 and the journal point 8 of the various rollers. A shorter distance of the front rollers in relation to the distance of the rear rollers will change the radius of the curve and shorten the swing. The front rollers will namely be pivoted to a greater respect in relation to the tilt angle because their radius is smaller than the radius of the rear rollers, which produces a sharper turn or swing.

In the case of a skate according to the aforegoing having separately attached rollers, the rollers may either be individually pivotal or mutually coupled in different combinations for common pivotal movement within each combination. The described roller attachment results in that the lateral pivotal or twisting movement of the rollers is determined by the angle to which the skate is tilted and by the speed at which the skater moves. With a skate of this construction, it is possible to take strides in essentially the same way as when ice-skating, and to change direction when moving forwards by tilting the skate. Thus, it is possible to make a turn when moving forwards without needing to lift the rollers from the underlying surface. When skating backwards, the roller holders are turned so that the rollers will begin to rotate in the opposite direction, that is when the holders can be rotated through 360°; see FIG. 5. This can be achieved when skating in a forward direction, by twisting the foot so as to glide over to a backward skating mode.

Figure 5:
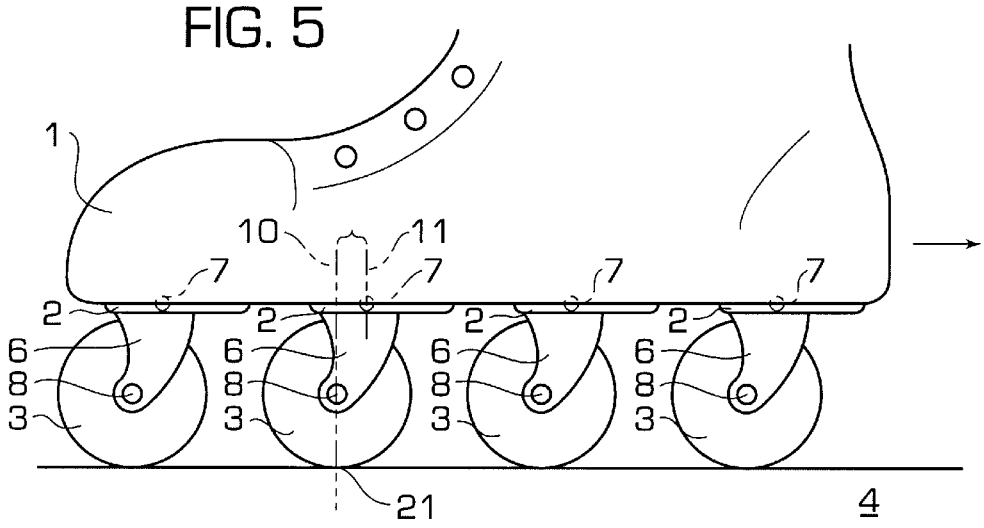
FIG. 5 is a view illustrating a roller-blade skate of FIG. 2 when moving backwards.

With the rollers in the positions shown in FIG. 5, the same conditions are obtained for backward skating as those obtained for forward skating, since the mutual positions of the lines 10 and 11 relative to the direction of movement become the same as when skating in a forward direction. Backward skating can therewith be achieved with essentially the same movements as those employed in ice-skating.

Figure 6A:
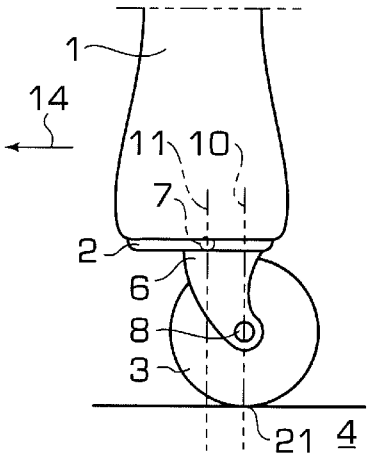
FIG. 6A is a rear view of the skate shown in FIG. 2 when it moves sideways.
Figure 6B:
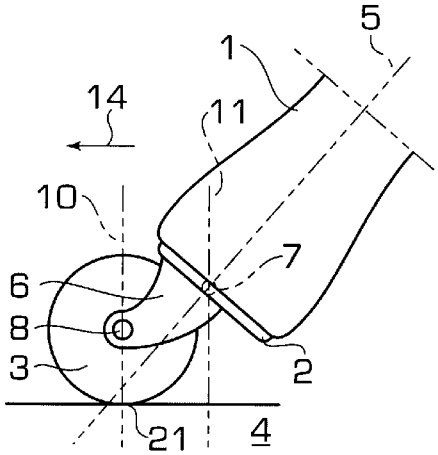
FIG. 6B is a rear view of the skate shown in FIG. 2 with the skate tilted to such an extent in a direction opposite to the direction of movement as to have reversed the rotational direction of the roller.

When skating sideways, the rollers adjust to the movement direction 14 with the same mutual relationships between the lines 10 and 11 as that earlier described; see FIG. 6A. If the skate is tilted heavily in a direction opposite to the movement direction 14, the rollers 3 will swing round to the position shown in FIG. 6B, in response to the force acting in the direction of the line 5. Since the direction of movement 14 of the skate is still the same, the rollers will rotate in a direction opposite to their preceding direction. This tilting of the skate corresponds to the tilt of an ice skate when skidding to an abrupt stop. The inventive roller skate can also be brought to the position shown in FIG. 6B for braking the skate. To this end, the roller 3 may be journalled in the holder 6 so as to be latched or braked in conjunction with reversing the rotational direction of the roller. All rollers may conveniently be braked in this way. However, it is also feasible to provide only one or a few rollers with this braking function.

Figure 7:
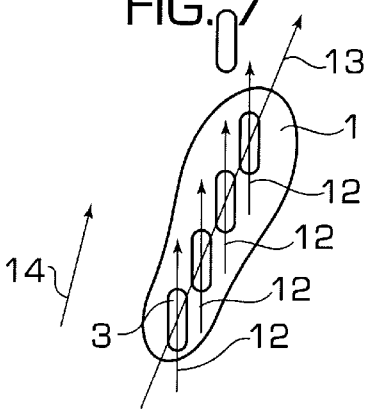
FIG. 7 illustrates the roller positions during a turn, when all rollers are attached in one and the same way.

As before mentioned, the direction of the rollers is determined by two factors. One factor is the direction of movement, which causes the rollers to strive to align themselves in the skating direction, by virtue of their holders. The second factor is the angle to which the skate is tilted, wherein tilting of the skate forces the roller centre line out from the centre of the skate in a direction opposite to the tilting direction. This means that when skating in an upright position, or with very slight tilting of the skate, the rollers will be aligned in this direction irrespective of how the skate is twisted in relation to the skating direction; see FIG. 7. However, if the skate is tilted markedly to one side or the other, tilting of the skate will force the rollers away from the centre line of the skate in a direction opposite to the tilting direction. This movement of the rollers strives to reset the balance towards the original position to straighten up the skate in relation to the underlying surface.

Figure 8:
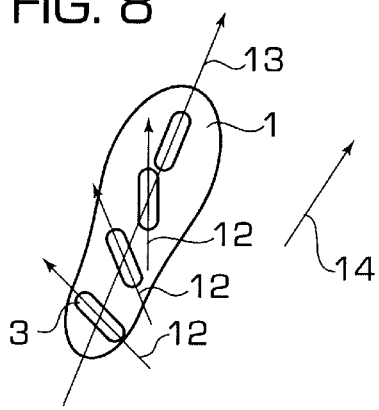
FIG. 8 illustrates the roller positions in a turn when the foremost roller is fixed in the longitudinal direction of the skate.

The individual positions of the rollers are changed when the front roller is fixed against pivotal or twisting movement in the longitudinal direction of the skate. The remaining rollers will then pivot in relation to the front roller in individual circles around a fixed point in relation to the front roller; see FIG. 8. A similar function is obtained when the front roller has only limited lateral movement, since this will influence the movement radius of remaining rollers. In addition to the front roller, one or more of the remaining rollers may also be fixed so that only one or more of the rollers can pivot.

Figure 9:
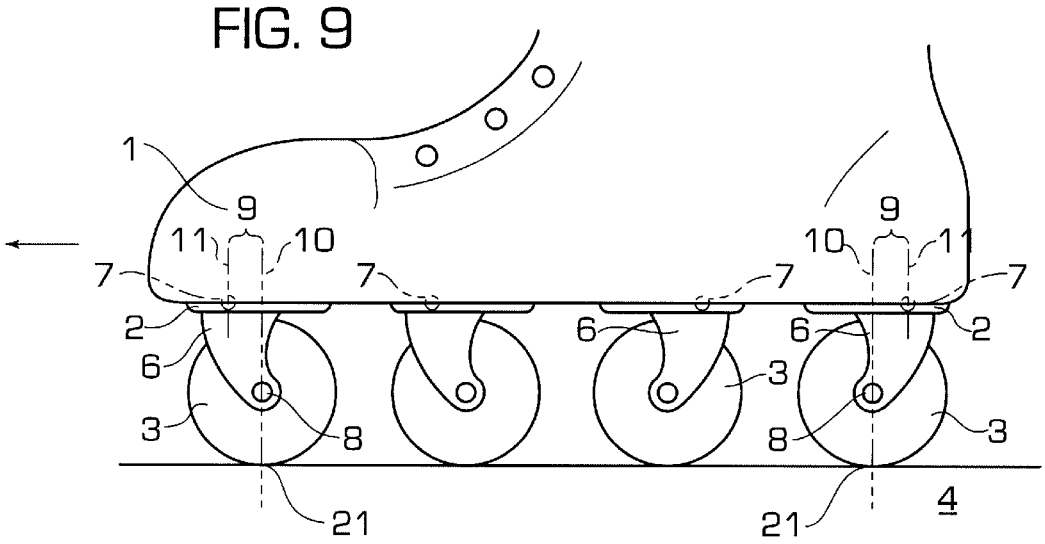
FIG. 9 illustrates another embodiment of an inventive roller skate.
Figure 9A:
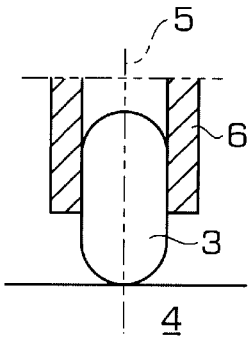
FIG. 9A illustrates a roller with the skate vertical.
Figure 9B:
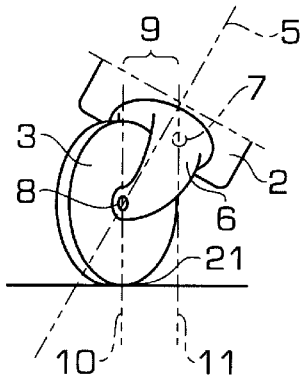
FIG. 9B is a rear view of one of the front rollers with the skate leaning to the right.
Figure 9C:
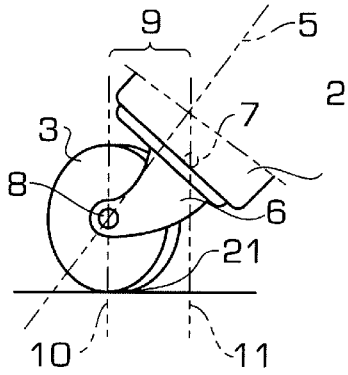
FIG. 9C is a rear view of one of the rear rollers with the skate leaning to the right.

FIG. 9 illustrates a modified embodiment of an inventive roller skate. In the case of this embodiment, the suspension of the two foremost rollers 3 is the same as the roller suspensions of the embodiment illustrated in FIG. 2 and have a corresponding function; see FIGS. 9A and 9B. The holders of the two rearmost rollers are turned in an opposite direction to the holders of the front rollers, therewith obtaining the relationship between line 10 and line 11 shown in FIG. 9C.

Figure 10A:
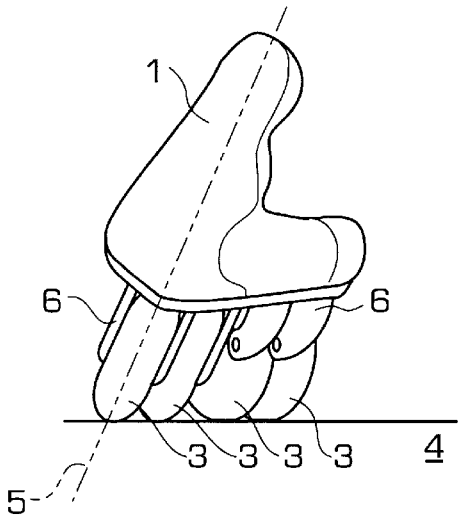
FIG. 10A shows the skate of FIG. 9 obliquely from the rear with the skate leaning to the right.
Figure 10B:
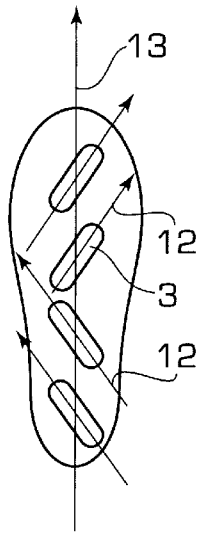
FIG. 10B shows the roller positions of the skate according to FIG. 10A as the skate moves forwards and leans to the right.

When skating in an upright position, the rollers run linearly behind each other in the same way as that illustrated in FIG. 4A. When the skate is tilted in negotiating a curve, the mutual position between the skate balance line 5 and the centre line 10 of the two foremost rollers 3 will be changed and give the same result as that described with reference to FIGS. 3C and 4C above. Correspondingly, the rear rollers with the same tilting angle will be pivoted in the opposite direction, see FIGS. 10A and 10B, therewith enabling a sharp turn to be made.

Figure 11:
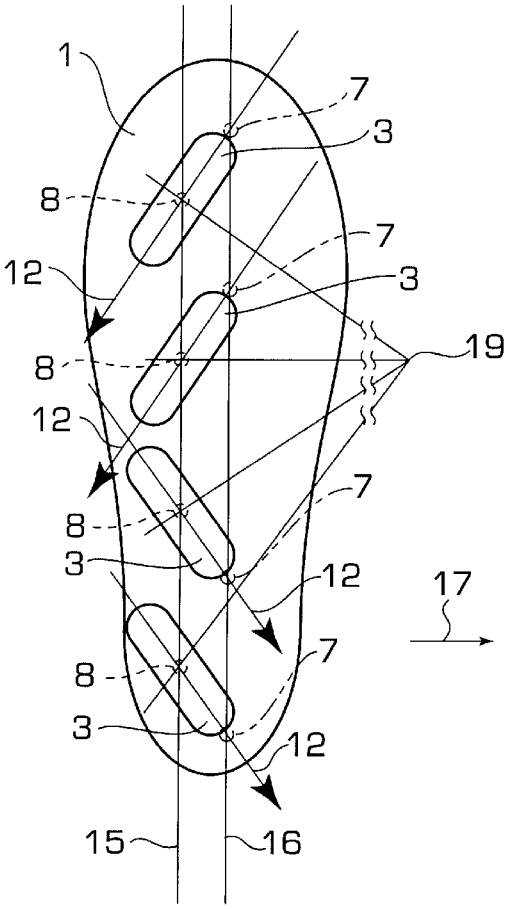
FIG. 11 illustrates the roller positions of the skate shown in FIG. 10A as the skate moves backwards and leans to the right.

FIG. 11 shows a point 19 around which the rollers move in circles. The same conditions also apply when skating backwards, as illustrated by the arrows in FIG. 11.

As earlier described, the swinging radius is influenced by individual differences in the distance 9 between the pivot point 7 and the journal point 8 of respective rollers 3.

Figure 12:
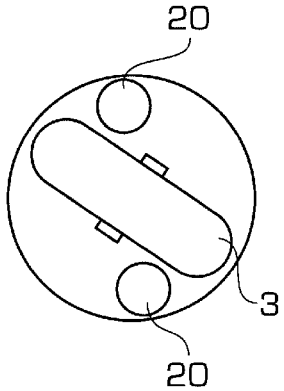
FIG. 12 illustrates brake means for braking one of the rollers.

FIG. 12 illustrates an alternative method of braking one or more rollers. In this case, brake blocks 20 made of friction-generating material are so arranged in relation to respective rollers 3 that the roller will make contact with the brake blocks 20 upon pivoting through a predetermined number of degrees.

Figure 13:
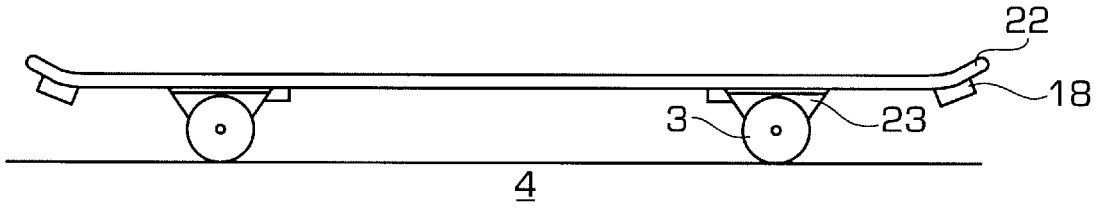
FIG. 13 illustrates a conventional skateboard having two pairs of rollers.

FIG. 13 illustrates a conventional skateboard 22 having a base provided with two roller suspensions 23. Reference numeral 18 identifies a rubber block which can be brought into contact with the underlying surface so as to brake the board, by tipping the board backwards.

Figure 13A:
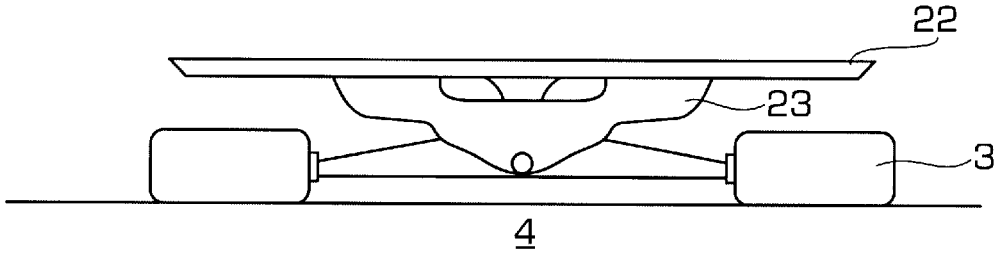
FIGS. 13A and 13B are rear views of the skateboard of FIG. 13 and show respectively the board in a horizontal and tilting position.
Figure 13B:
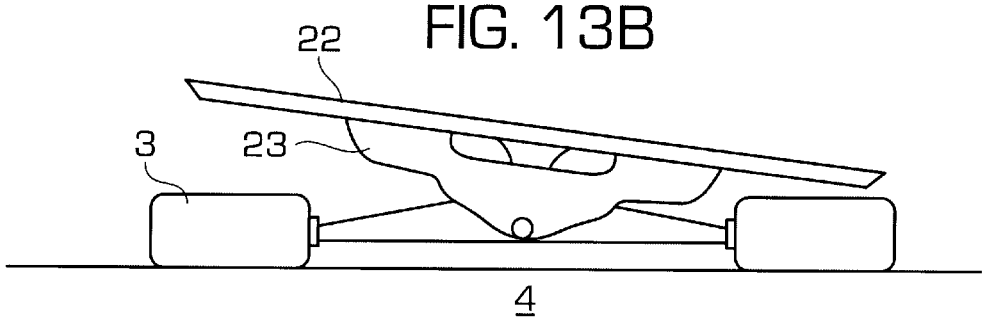

As will be seen from FIGS. 13A and 13B, a pair of rollers 3 are each suspended in a respective roller suspension 23. The board 22 can be tipped sideways in relation to the rollers.

FIG. 14 illustrates a modified version of the inventive skateboard 22. This skateboard includes at least one row of sequentially arranged rollers 3 whose roller axles are journalled at 8 in holders 6 which are pivotally mounted to a base 23. The holders 6 are conveniently freely pivotal through 360° around an associated pivot point 7.

Figure 2B:
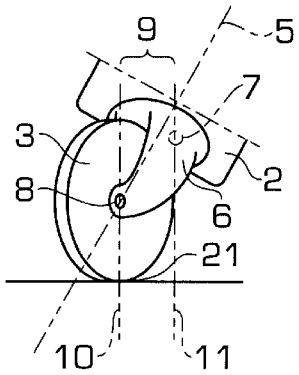
Figure 2C:
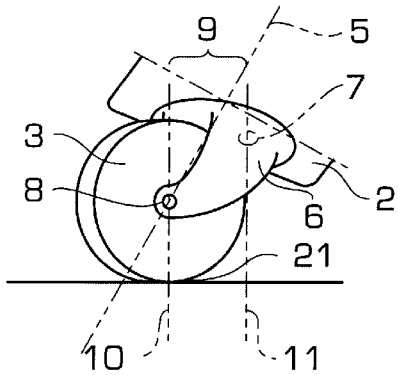

FIG. 14A is a rear view of the skateboard and FIGS. 14B and 14C show the position of respective rollers 3 in relation to the board when the board is horizontal and tilted respectively; see the description of FIGS. 2B and 2C.

When travelling with the skateboard horizontally, the skateboard can easily be twisted sideways without the rollers or the direction of travel changing; see FIG. 14D. When the skateboard is tilted to move in a curved path, the rollers will be pivoted in the same way as that described above with reference to a roller skate.

FIG. 15 illustrates an alternative embodiment in which the foremost roller is fixed in the longitudinal direction of the board 22. This provides the same function and gives the same result as that discussed above with reference to the roller skate shown in FIG. 8.

FIG. 16A illustrates conditions when travelling sideways with the board 22 slightly tilted, whereas FIG. 16B illustrates reversal of the direction of rotation of the rollers 3 when the board is tipped more steeply. This function can be utilized to brake the skateboard, similar to the afore-described roller skate.

From the point of view of balance, it may be desirable to use two rows of rollers instead of one, with the rollers being disposed in pairs of sideways adjacent rollers. Alternatively, the rollers can be given a greater width, so as to obtain the shape of stubby rollers.

Although the invention has been described in the aforegoing with reference to a number of preferred exemplifying embodiments thereof, it will be understood that variations and modifications can be made in several respects within the scope of the following claims. For instance, the number of rollers and the design of the roller holders may be varied as desired.

What is claimed is:

1. A roller contrivance intended for at least one foot, comprising a base frame (2; 23) and at least one row of rollers (3) mounted mutually and sequentially on said base frame, characterized in that at least a foremost of said rollers is journalized in a holder which is fixed relatively to said base frame, and in that at least one other roller (3) is journalized at a corresponding roller journal point in a holder (6) which is pivotally mounted to said base frame (2; 23) for pivotal movement through 360° about an axis which extends perpendicularly to a rotational axis of said at least one other roller (3) and is located at a given distance from a corresponding roller center line (10), wherein for each pivotally mounted roller, the corresponding roller center line is a line which passes through the corresponding roller journal point (8) and through a point of contact (21) of the pivotally mounted roller with an underlying rolling surface.

2. The contrivance according to claim 1, characterized in that the rollers (3) in each row are disposed along a straight line.

3. The contrivance according to claim 1, characterized in that at least one pivotally mounted roller (3) is pivotal about an axis which, when said at least one pivotally mounted roller points straight ahead, is located forwardly of the corresponding roller center line (10).

4. The contrivance according to claim 3, characterized in that at least one other pivotally mounted roller (3) that is located further back than said at least one pivotally mounted roller which is pivotal about an axis located forwardly of the corresponding center line is pivotal about an axis which, when said at least one other pivotally mounted roller points straight ahead, is located rearwardly of the corresponding roller center line (10).

5. The contrivance according to claim 1, characterized in that only said foremost roller (3) is fixed and in that said other rollers (3) are pivotally mounted such that each of said pivotally mounted rollers is pivotable about an associated axis which is located forwardly of the corresponding center line when said corresponding pivotally mounted roller points straight ahead.

6. The contrivance according to claim 1, characterized in that the contrivance includes four rollers (3); that the foremost roller (3) is fixed; that the next roller in the row is pivotally mounted such that said next roller is able to pivot about an associated axis which, when said next roller points straight ahead, is located forwardly of the corresponding roller center line (10); and in that said two rear rollers are pivotally mounted such that each of said two rear rollers is pivotal about an associated axis which, when said associated roller points straight ahead, said associated axis is located behind the corresponding roller center line (10).

7. The contrivance according to claim 1, characterized in that each of the pivotal rollers (3) can be pivoted individually and freely through 360°.

8. The contrivance according to claim 1, characterized in that at least one pivotal roller (3) provides a braking facility in one direction of rotation.

9. The contrivance according to claim 1, characterized in that at least one pivotal roller is adapted to be braked by coaction with a brake device when said pivotal roller is pivoted through a predetermined angle.

10. The contrivance according to claim 1, wherein said rollers form part of a roller skate.

11. The contrivance according to claim 1, wherein said rollers form part of a skate board.

12. The contrivance according to claim 1, wherein said rollers form part of a roller ski.

* * * * *